US009666972B2

(12) United States Patent
Martin et al.

(10) Patent No.: US 9,666,972 B2
(45) Date of Patent: May 30, 2017

(54) ELECTRICAL CONNECTOR

(71) Applicant: Tyco Electronics Corporation, Berwyn, PA (US)

(72) Inventors: Galen M. Martin, Camp Hill, PA (US); James O. Crawford, Greensboro, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 141 days.

(21) Appl. No.: 14/540,525

(22) Filed: Nov. 13, 2014

(65) Prior Publication Data

US 2016/0141790 A1 May 19, 2016

(51) Int. Cl.

| | |
|---|---|
| ***H01R 13/514*** | (2006.01) |
| ***H01R 13/436*** | (2006.01) |
| ***H01R 13/506*** | (2006.01) |
| ***H01R 9/24*** | (2006.01) |
| ***H01R 13/642*** | (2006.01) |

(52) U.S. Cl.

CPC ..... *H01R 13/506* (2013.01); *H01R 9/24* (2013.01); *H01R 13/4362* (2013.01); *H01R 13/642* (2013.01); *H01R 2201/26* (2013.01)

(58) Field of Classification Search

CPC ..... H01R 13/506; H01R 13/642; H01R 9/24

USPC ..... 439/752, 712, 489, 595, 352, 357

See application file for complete search history.

(56) References Cited

U.S. PATENT DOCUMENTS

| | | | | | |
|---|---|---|---|---|---|
| 4,971,579 | A * | 11/1990 | Mobley | H01R 13/4361 | 439/592 |
| 4,973,268 | A * | 11/1990 | Smith | H01R 13/443 | 439/589 |
| 5,071,369 | A * | 12/1991 | Denlinger | H01R 13/4365 | 439/595 |
| 5,403,211 | A * | 4/1995 | Sayer | H01R 13/4362 | 439/603 |
| 5,489,224 | A * | 2/1996 | Schwarz | H01R 13/4362 | 439/466 |
| 5,554,055 | A * | 9/1996 | Miller | H01R 13/4362 | 439/752 |

(Continued)

FOREIGN PATENT DOCUMENTS

| | | |
|---|---|---|
| GB | 2 432 466 A | 5/2007 |
| WO | 2008 / 023009 A1 | 2/2008 |

OTHER PUBLICATIONS

European Search Report, Mail Date, Mar. 15, 2016, EP 15 19 3949, Application No. 15193949.3-1801.

*Primary Examiner* — Amy Cohen Johnson
*Assistant Examiner* — Milagros Jeancharles

(57) ABSTRACT

An electrical connector includes a front housing having front terminal channels and rear housing having rear terminal channels aligned with the front terminal channels. An ISL device is coupled to the housing with a front plate positioned in front of the front housing and a lock plate positioned between the front housing and the rear housing. The ISL device has a staged mating sequence with the housing, wherein in a first stage, lock plate channels are aligned with the front and rear terminal channels to allow the terminals to at least partially pass therethrough, and wherein in a second stage, the lock plate is moved relative to the housing to a blocking position where the lock plate blocks the terminals from removal from the front terminal channels.

20 Claims, 6 Drawing Sheets

(56) References Cited

U.S. PATENT DOCUMENTS

| | | | | | |
|---|---|---|---|---|---|
| 5,782,657 | A * | 7/1998 | Wolla | H01R 13/4362 | 439/595 |
| 5,928,038 | A * | 7/1999 | Berg | H01R 13/6272 | 439/489 |
| 5,997,364 | A * | 12/1999 | Matsuoka | H01R 13/4362 | 439/595 |
| 6,004,158 | A * | 12/1999 | Ward | H01R 13/4361 | 439/595 |
| 6,257,918 | B1 * | 7/2001 | Yamamoto | H01R 13/6315 | 439/34 |
| 6,305,990 | B1 * | 10/2001 | Ward | H01R 13/432 | 439/752 |
| 6,568,948 | B2 * | 5/2003 | Matsuoka | H01R 13/4361 | 439/271 |
| 7,387,545 | B2 * | 6/2008 | Tyler | H01R 13/4365 | 439/595 |
| 8,419,485 | B2 * | 4/2013 | Stausser | H01R 13/4362 | 439/559 |
| 8,597,043 | B2 * | 12/2013 | Zhao | H01R 13/707 | 307/10.1 |
| 8,926,344 | B2 * | 1/2015 | Jozwiak | B60R 16/0238 | 439/140 |
| 2002/0086575 | A1 * | 7/2002 | Marpoe, Jr. | H01R 13/64 | 439/352 |
| 2014/0199891 | A1 * | 7/2014 | Jozwiak | H01R 24/66 | 439/655 |

* cited by examiner

ELECTRICAL CONNECTOR

BACKGROUND OF THE INVENTION

The subject matter herein relates generally to electrical connectors holding terminals.

In various applications of electrical connectors, devices are utilized to lock terminals in place and to assure that the terminals are in proper position within the electrical connector. Such electrical connectors are typically used in harsh environments, such as automotive applications, in which the electrical connectors are subject to vibration and other forces that may tend to have the terminals back out of the connectors.

Currently, certain electrical connectors are provided with housings having cavities extending therethrough for receiving terminals. The terminals are locked in the cavities by a primary latch, which may be part of the housing or part of the terminal itself. Furthermore, the electrical connectors typically include a secondary lock that acts as a backup locking feature should the primary lock fail. Such secondary locks are typically a separate piece. Tooling for such parts are typically complicated, expensive and time consuming to build.

A need remains for an electrical connector that may be manufactured and assembled in a cost effective and reliable manner.

BRIEF DESCRIPTION OF THE INVENTION

In one embodiment, an electrical connector is provided that includes a housing including a front housing and a rear housing separately provided from and matable to the front housing to define the housing. The front housing has front terminal channels configured to receive terminals. The front housing has front keying features for aligning the front housing with the rear housing for mating thereto. The rear housing has rear terminal channels aligned with the front terminal channels when the rear housing is mated with the front housing. The rear housing has rear keying features that interact with the front keying features to align the front housing with the rear housing during mating. An independent secondary lock (ISL) device is coupled to the housing. The ISL device has a front plate positioned in front of the front housing with front plate channels therethrough configured to be aligned with the front terminal channels. The ISL device has a lock plate positioned between the front housing and the rear housing with lock plate channels therethrough. The ISL device has a staged mating sequence with the housing, wherein in a first stage, the lock plate channels are aligned with the front and rear terminal channels to allow the terminals to at least partially pass therethrough from the rear terminal channels into the front terminal channels during loading of the terminals into the housing, and wherein in a second stage, the lock plate is moved relative to the housing to a blocking position where the lock plate blocks the terminals from removal from the front terminal channels.

In another embodiment, an electrical connector is provided that includes a housing including a front housing and a rear housing separately provided from and matable to the front housing to define the housing. The front housing has front terminal channels configured to receive terminals. The front housing has terminal latches configured to latchably secure the terminals in corresponding front terminal channels. The front housing is manufactured from a first dielectric material. The rear housing has rear terminal channels aligned with the front terminal channels when the rear housing is mated with the front housing. The rear housing is manufactured from a second dielectric material different than the first dielectric material. An independent secondary lock (ISL) device is coupled to the housing. The ISL device has a front plate positioned in front of the front housing with front plate channels therethrough configured to be aligned with the front terminal channels. The ISL device has a lock plate positioned between the front housing and the rear housing with lock plate channels therethrough. The lock plate is configured to be positioned in a blocking position where the lock plate blocks the terminals from removal from the front terminal channels.

DETAILED DESCRIPTION OF THE INVENTION

Figure 1:
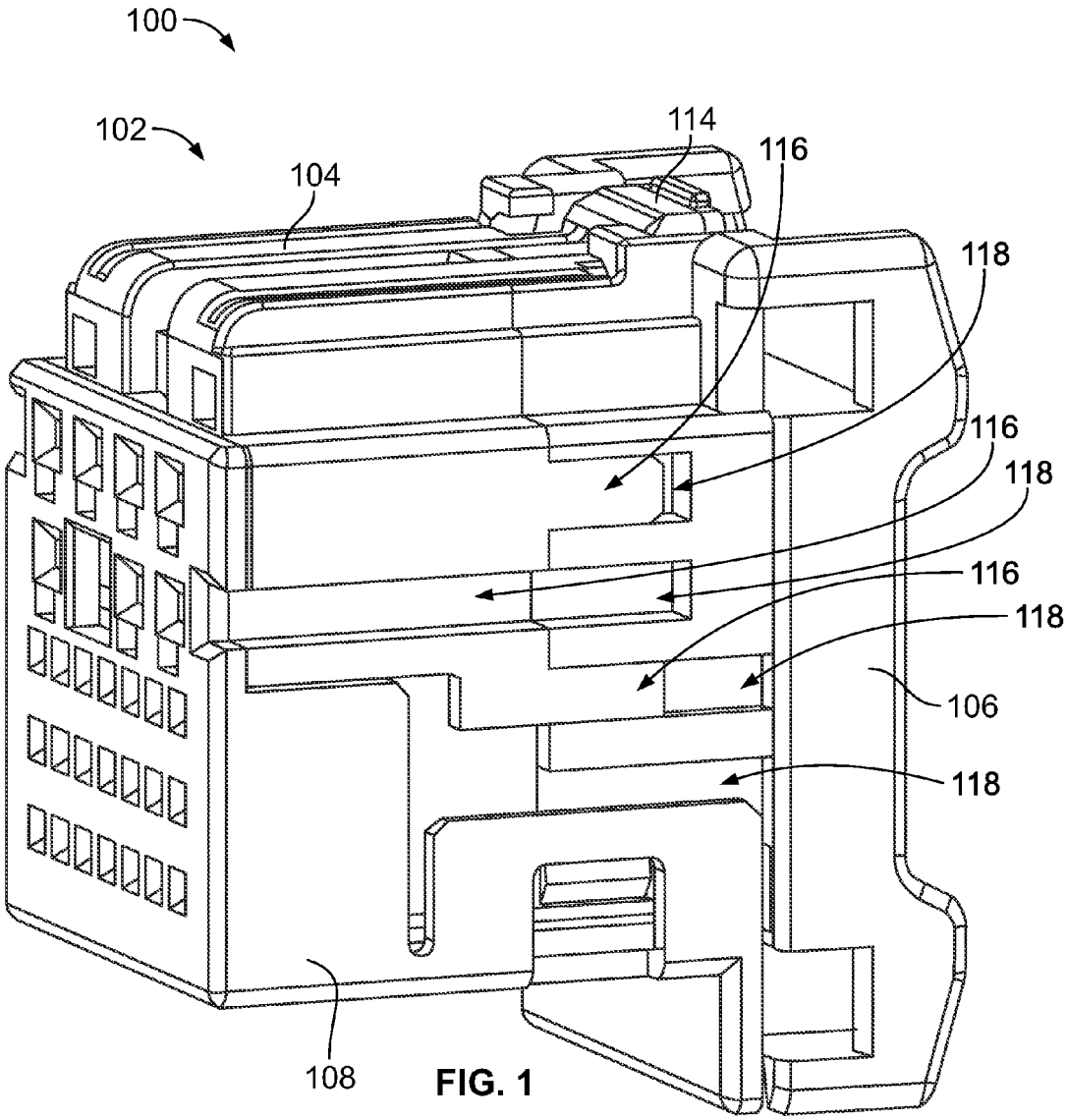
FIG. 1 is a front perspective of an electrical connector formed in accordance with an exemplary embodiment showing the electrical connector in a locked position.
Figure 2:
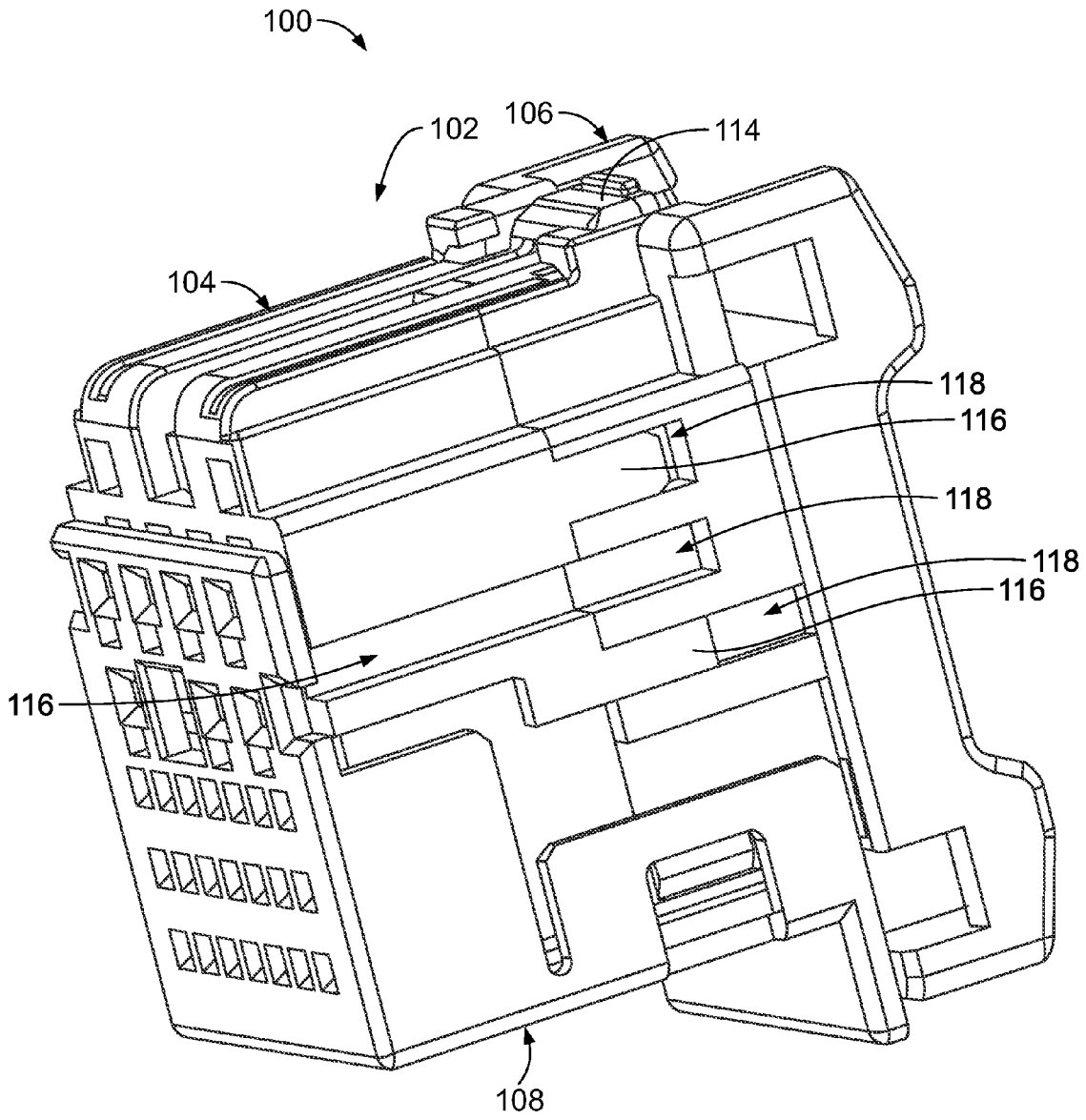
FIG. 2 is a front perspective view of the electrical connector in an unlocked position.

FIG. 1 is a front perspective of an electrical connector 100 formed in accordance with an exemplary embodiment, showing the electrical connector in a locked position. FIG. 2 is a front perspective view of the electrical connector 100 in an unlocked position.

The electrical connector 100 includes a housing 102 having a front housing 104 and a rear housing 106 matable to the front housing 104 to define the housing 102. The front housing 104 is separate and discrete from the rear housing 106 and the front and rear housings 104, 106 are coupled together during assembly. For example, the front and rear housings 104, 106 may be secured together by adhesive. Alternatively, the front and rear housings 104, 106 may be secured together by fasteners or other securing components. In an exemplary embodiment, the front and rear housings 104, 106 are molded housings. The front housing 104 is molded from a first dielectric material during a molding process and the rear housing 106 is molded from a second dielectric material during a different molding process. In an exemplary embodiment, the dielectric material of the front housing 104 is different than the dielectric material of the rear housing 106. For example, the front housing 104 may include intricate components, such as terminal latches, that are susceptible to damage during use, and thus need to be manufactured from a higher strength or higher performance material, while the rear housing 106 may be manufactured from a less expensive material as the performance characteristics of the rear housing 106 are less demanding.

The electrical connector 100 includes an independent secondary lock (ISL) device 108 that is coupled to the housing 102 and that is movable between an unlocked position (FIG. 2) and a locked position (FIG. 1). The ISL device 108 is used as a secondary lock to lock terminals in the housing 102.

The electrical connector 100 may be used in an application, such as in an automotive vehicle system, that involves the interconnection of electrical or fiber optic conductors within the system. The electrical connector 100 represents a robust, low cost, compact design. Furthermore, the configuration and arrangement of the electrical connector 100 enables use of simplified design and manufacturing processes, increasing turnover and lowering cost without adversely impacting quality and reliability.

The front housing 104 is configured to hold a plurality of terminals 110 (shown in FIGS. 5 and 6) that are configured to be mated with corresponding mating contacts of a mating connector (not shown). The terminals 110 are terminated to ends of cables 112 (shown in FIGS. 5 and 6). For example, the terminals 110 may be crimped to the cables 112; however the terminals 110 may be terminated by other processes, such as soldering, insulation displacement, poke-in, and the like.

In an exemplary embodiment, the rear housing 106 is used to guide the terminals 110 into the front housing 104 during assembly. For example, the terminals 110 are loaded into the front housing 104 through the rear housing 106. The terminals 110 are able to freely pass through the ISL device 108 when the ISL device 108 is in the unlocked position. The front housing 104 includes features, such as terminal latches, used to secure the terminals 110 therein. The terminal latches operate as primary securing features for securing the terminals 110 in the front housing 104. The ISL device 108 is used as a secondary securing feature for securing the terminals 110 in the front housing 104, such as if the terminal latches were to break. For example, the ISL device 108 is moved to the locked position (FIG. 1) and the ISL device 108 physically blocks the terminals 110 from removal from the front housing 104 in the locked position. Optionally, the ISL device 108 may additionally operate as a terminal position assurance (TPA) device by assuring that each of the terminals 110 are fully loaded into the front housing 104. For example, the ISL device 108 may be unable to move from the unlocked position (FIG. 2) to the locked position (FIG. 1) unless all of the terminals 110 are fully loaded into the front housing 104. The terminals 110 are held in the front housing 104 for mating with the mating terminals of the mating connector and the cables 112 exit the housing 102 from the rear housing 106. Optionally, the rear housing 106 may surround portions of the terminals 110.

A housing latch 114 is used to secure the electrical connector 100 to the mating connector. In the illustrated embodiment, the housing latch 114 extends from the front housing 104. Alternatively, the housing latch 114 may extend from the rear housing 106.

The front housing 104 includes front keying features 116 and the rear housing 106 includes rear keying features 118. The keying features 116, 118 are used to align the front housing 104 with the rear housing 106 during mating of the front housing 104 to the rear housing 106. Optionally, the keying features 116 and/or 118 may be used to align the electrical connector 100 with respect to the mating connector during mating of the electrical connector 100 to the mating connector. The keying features 116, 118 are used for keyed mating, wherein the electrical connector 100 may be mated with the mating connector in a single orientation, defined by the keying features 116, 118. For example, the vertical positions of the keying features 116, 118 on the sides of the housing 102 may be varied to define different interfaces. In an exemplary embodiment, the electrical connector 100 may have different types of front housings 104 that have different arrangements of keying features 116 and define different mating interfaces, such as for mating with different types of mating connectors. The rear housing 106 may accept the different types of front housings 104 such that the mating interface of the electrical connector 100 may be changed by simply choosing a different front housing 104, but the overall cost of manufacturing the electrical connectors 100 is reduced by using the same rear housing 106, which reduces the tooling costs. For example, the arrangement of the rear keying features 118 may accommodate different arrangements of front keying features 116, which are matable with different mating connectors.

Figure 3:
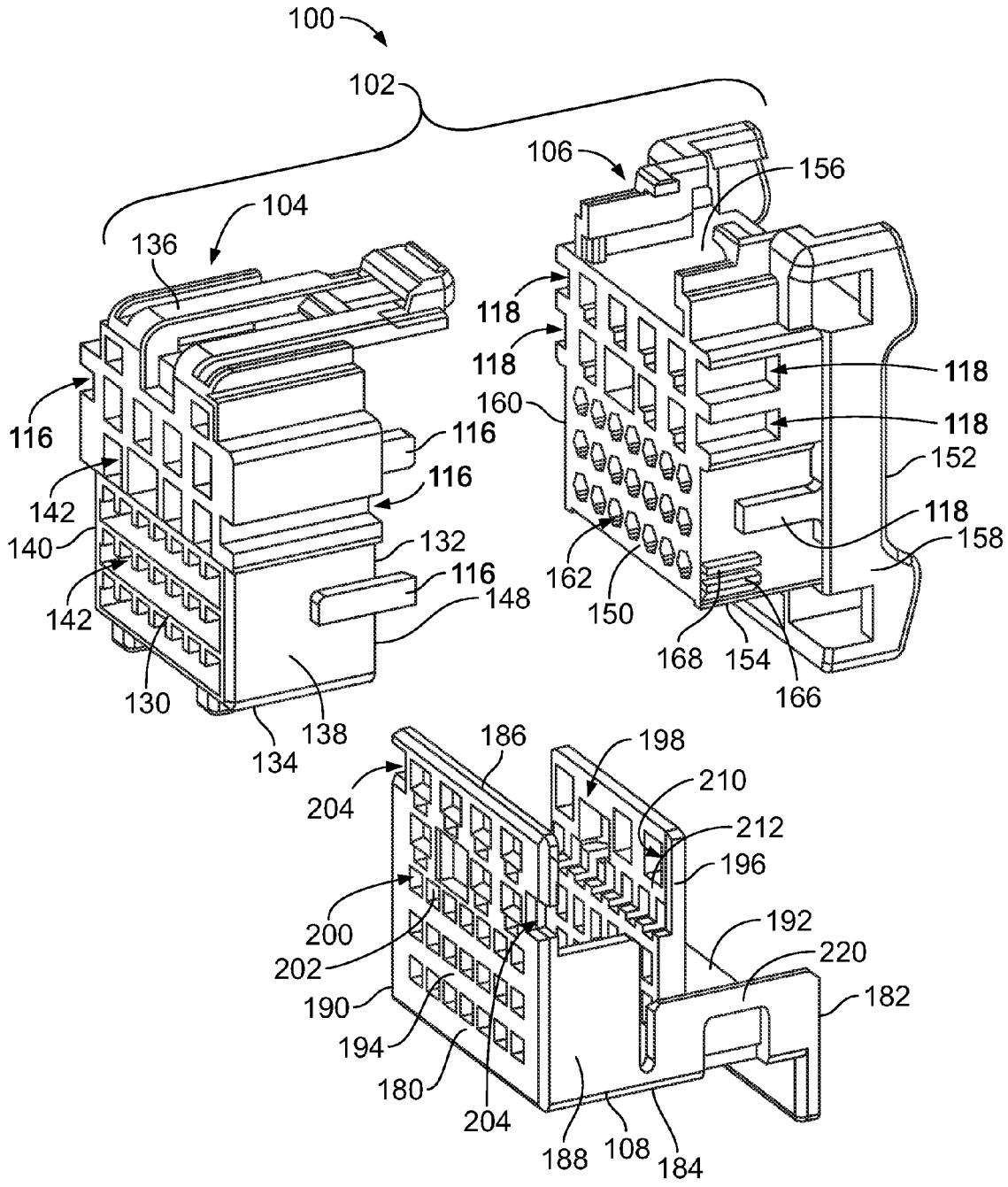
FIG. 3 is a front perspective, exploded view of the electrical connector.
Figure 4:
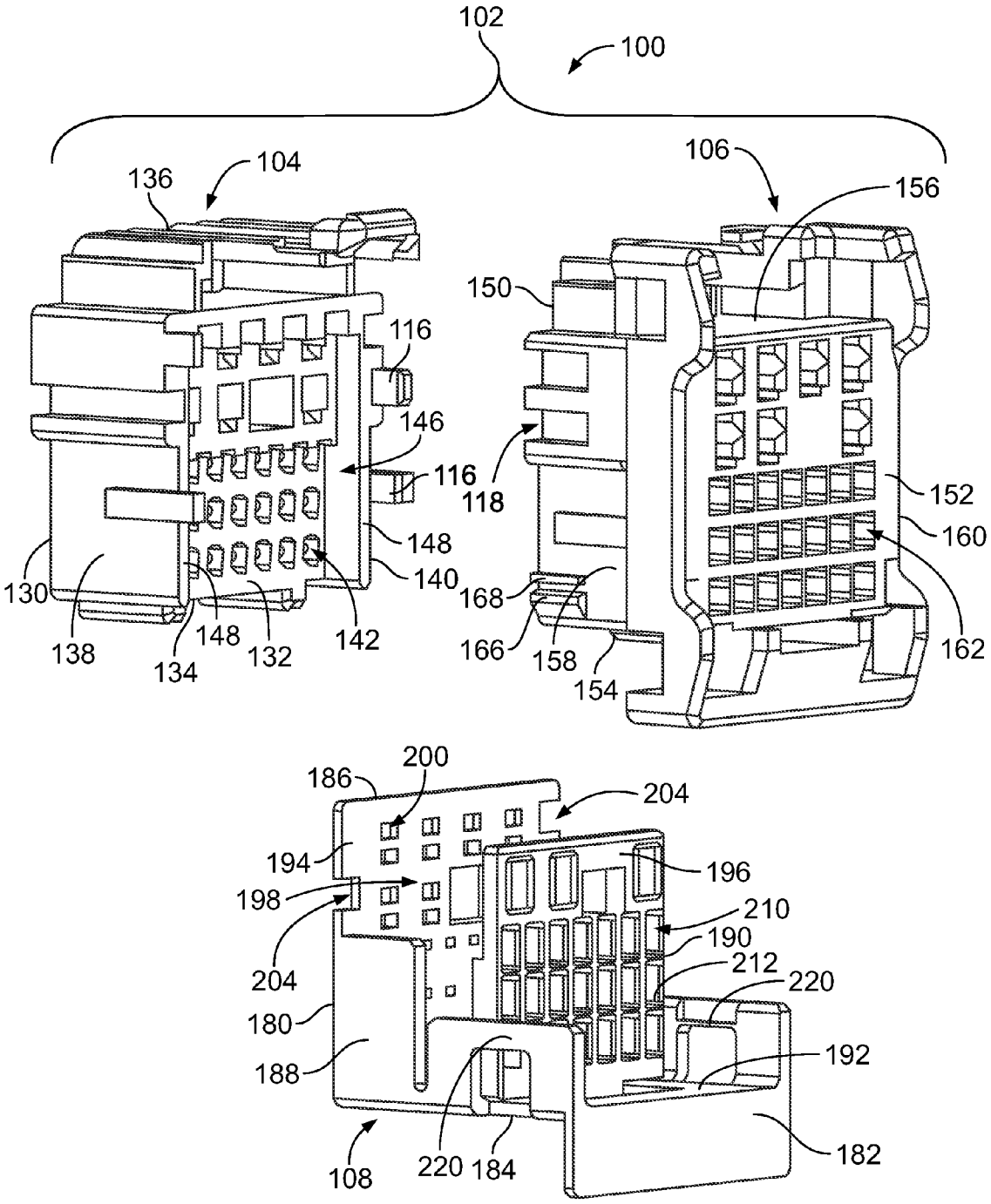
FIG. 4 is a rear perspective, exploded view of the electrical connector.

FIG. 3 is a front perspective, exploded view of the electrical connector 100. FIG. 4 is a rear perspective, exploded view of the electrical connector 100. The terminals and cables are not shown in FIGS. 3 and 4.

The front housing 104 is manufactured from a dielectric material. The front housing 104 includes a front 130, a rear 132, a bottom 134, a top 136 and opposite sides 138, 140. The rear 132 may be non-planar, and stepped, such as to accommodate different length terminals 110 (shown in FIG. 5) between the front 130 and the rear 132, such as longer terminals near the top 136 and shorter terminals near the bottom 134.

The front housing 104 has a plurality of front terminal channels 142 extending between the front 130 and the rear 132. The front terminal channels 142 are arranged in a plurality of rows and a plurality of columns. Any number of front terminal channels 142 may be provided, corresponding to the number of terminals 110 (shown in FIG. 5) of the electrical connector 100. The front terminal channels 142 are configured to receive corresponding terminals 110 therein. The terminals 110 are configured to be secured in the front terminal channels 142, such as by terminal latches, which may be part of the front housing 104.

The front housing 104 includes a pocket 146 at the rear 132. The pocket 146 is defined along the sides by edges 148. Optionally, the pocket 146 may be open at the bottom 134. A portion of the ISL device 108 is configured to be received in the pocket 146, such as through the open bottom. The rear 132 is stepped in the pocket 146 such that the pocket 146 has different depths in the various regions of the pocket 146. For example, the pocket 146 is deeper near the bottom 134 and shallower near the top 136. Optionally, a portion of the rear housing 106 may be received in the pocket 146.

In the illustrated embodiment, the front keying features 116 are keying posts, which may be referred to hereinafter as keying posts 116. The keying posts 116 extend rearward from the rear 132. The keying posts 116 are used to align and/or secure the front housing 104 to the rear housing 106. Any number of keying features 116 may be provided. Other types of keying features 116 may be used in alternative embodiments, such as slots, tabs, and the like. The keying posts 116 may be positioned at various vertical positions relative to the top 136 and the bottom 134, such as to define different types of front housings 104. Optionally, the keying features 116 extending from the first side 138 may be at different vertical positions than the keying features 116 extending from the second side 140.

The rear housing 106 is manufactured from a dielectric material. The rear housing 106 includes a front 150, a rear 152, a bottom 154, a top 156 and opposite sides 158, 160. In an exemplary embodiment, the front 150 is sized and shaped to correspond with the rear 132 of the front housing 104. The front 150 is configured to abut against the rear 132 of the front housing 104 and/or the ISL device 108. Optionally, the front 150 may be planar and may abut against the edges 148 at the rear 132 and/or against a portion of the ISL device 108.

The rear housing 106 has a plurality of rear terminal channels 162 extending between the front 150 and the rear 152. The terminal channels 162 are configured to be aligned with the front terminal channels 142 when the rear housing 106 is coupled to the front housing 104 to allow assembly by loading of the terminals 110 into the front terminal channels 162 through the rear terminal channels 162.

In the illustrated embodiment, the rear keying features 118 are keying slots, which may be referred to hereinafter as keying slots 118. The keying slots 118 are provided in the exterior surfaces of the sides 158, 160. The keying slots 118 receive the keying posts 116 and may receive keying features of the mating connector. Any number of keying features 118 may be provided. The keying slots 118 may be positioned at various vertical positions relative to the top 156 and the bottom 154. Optionally, fewer than all of the keying slots 118 receive keying posts 116 of the particular front housing 104, because the other keying slots 118 may receive keying posts of a different front housing.

The rear housing 106 includes first and second securing features 166, 168 that are used to secure the ISL device 108 at different staged locations relative to the rear housing 106 during assembly, such as in the unlocked position (FIG. 2), which may constitute a first stage, and in the locked position (FIG. 1), which may constitute a second stage. In an exemplary embodiment, the securing features 166, 168 are latches and may be referred to hereinafter as first and second latches 166, 168. Other types of securing features may be used in alternative embodiments. The latches 166, 168 are provided on the sides 158, 160, such as at or near the bottom 154. The latches 166, 168 are oriented horizontally, such as parallel to the bottom 154. In an exemplary embodiment, the first latch 166 is positioned below the second latch 168 such that the first latch 166 holds the ISL device 108 in a lower position relative to the second latch 168. The ISL device 108 may be movable relative to the rear housing 106 between the first stage and the second stage to move the ISL device 108 from the unlocked position to the locked position. The ISL device 108 may be movable in a vertical direction between the first and second stages (e.g. between the unlocked and locked positions). Optionally, the latches 166, 168 may be wedge shaped. The latches 166, 168 may have other shapes or configurations in alternative embodiments.

During assembly, the rear housing 106 is coupled to the front housing 104 and the front housing 104 defines a front of the housing 102 and the rear housing 106 defines a rear of the housing 102. Optionally, portions of the front housing 104 may surround the rear housing 106. The front 150 of the rear housing 106 may abut against the rear 132 of the front housing 104 with the pocket 146 therebetween. The front 150 of the rear housing 106 may abut against portions of the ISL device 108. Optionally, the rear housing 106 may be a significant portion of the housing 102. For example, the rear housing 106 may be approximately half of a volume of the housing 102.

The ISL device 108 is manufactured from a dielectric material. The ISL device 108 includes a front 180, a rear 182, a bottom 184, a top 186, and opposite sides 188, 190. The ISL device 108 includes a bottom wall 192 along the bottom 184. The ISL device 108 includes a front plate 194 extending from the bottom wall 192 at the front 180. The ISL device 108 includes a lock plate 196 extending from the bottom wall 192 and spaced apart from the front plate 194. Optionally, the lock plate 196 may be approximately centered between the front 180 and the rear 182; however, the lock plate 196 may be located at any position along the bottom wall 192 in alternative embodiments. A cavity 198 is defined between the lock plate 196 and the front plate 194. The cavity 198 is sized and shaped to receive the front housing 104. When the ISL device 108 is coupled to the housing 102, the front plate 194 is positioned forward of the front 130 of the front housing 104. The lock plate 196 is received in the pocket 146 and is positioned forward of the front 150 of the rear housing 106.

The front plate 194 includes a plurality of front plate channels 200 extending therethrough. The front plate channels 200 are arranged in a plurality of rows and a plurality of columns. Any number of front plate channels 200 may be provided, corresponding to the number of front terminal channels 142 and associated terminals 110. The front plate channels 200 are configured to receive mating terminals of the mating connector and guide the mating terminals of the mating connector into the front terminal channels 142 for mating with the terminals 110. In an exemplary embodiment, the front plate channels 200 have lead-in surfaces 202. The lead-in surfaces 202 guide the mating terminals into the front plate channels 200 and the front terminal channels 142 during mating with the mating connector. The lead-in surfaces 202 may provide lead-in in four directions, such as from the top, bottom, and both sides of the front plate channels 200.

In an exemplary embodiment, the ISL device 108 includes keying features 204, such as keying slots in the sides 188, 190. The keying features 204 may be used for keyed mating with the mating connector to insure that a particular type of mating connector is mated with the electrical connector 100 and/or the mating connector is mated in a particular orientation. The keying features 204 may be aligned with the front keying features 116 of the front housing 104 when the ISL device 108 is coupled to the housing 102. Optionally, the keying features 204 may only be aligned with the keying features 116 when the ISL device 108 is moved to the locked position (FIG. 1).

The lock plate 196 includes a plurality of lock plate channels 210 extending therethrough. The lock plate channels 210 are configured to be aligned with the front terminal channels 142 and/or the rear terminal channels 162. For example, when the lock plate 196 is positioned in the pocket 146, the lock plate channels 210 are aligned with the rear terminal channels 162, such as to allow the terminals 110 to be loaded into the front housing 104 through the rear terminals channels 162 and through the lock plate channels 210. When the ISL device 108 is moved to the locked position, the lock plate channels 210 are no longer registered with the front terminals channels 142, but rather the lock plate 196 is moved upward relative to the front housing 104 to a blocking position such that the lock plate 196 blocks the terminals from being removed from the front terminal channels 142. The lock plate 196 includes blocking surfaces 212 adjacent to corresponding lock plate channels 210. When the lock plate 196 is moved to the second stage or blocking position, the blocking surfaces 212 are aligned with corresponding front terminal channels 142 to block removal of the terminals 110 from the front terminals channels 142.

The lock plate 196 is sized and shaped to be received in the pocket 146. In an exemplary embodiment, the lock plate 196 has sections of different thicknesses corresponding to the different regions of the pocket 146. The lock plate 196 is sized to be moved upward in the pocket 146 from the first stage or unlocked position to the second stage or locked position.

The ISL device 108 includes latching mechanisms 220 on both sides 188, 190. The latching mechanisms 220 are configured to be latchably secured to the latches 166, 168 along the sides 158, 160 of the rear housing 106. In the illustrated embodiment, the latch mechanisms 220 are defined by shoulders forming catches that are configured to be secured by the latches 166, 168. Other types of latching mechanisms may be used in alternative embodiments. The latching mechanisms 220 may be positioned to latchably couple to the front housing 104 in addition to or in the alternative to latching to the rear housing 106.

During assembly, the ISL device 108 is coupled to the housing 102 such that the latch mechanisms 220 engage the first latches 166. The first latches 166 hold the ISL device 108 in the first stage in an unlocked position. After the terminals 110 are loaded into the front housing 104, the ISL device 108 may be moved to the second stage or locked position. For example, the ISL device 108 is pushed upward until the latch mechanisms 220 engage the second latches 168. The second latches 168 hold the ISL device 108 in the second stage or locked position. The ISL device may be used to help couple the front housing 104, which is captured between the front plate 194 and the lock plate 196, to the rear housing 106.

Figure 5:
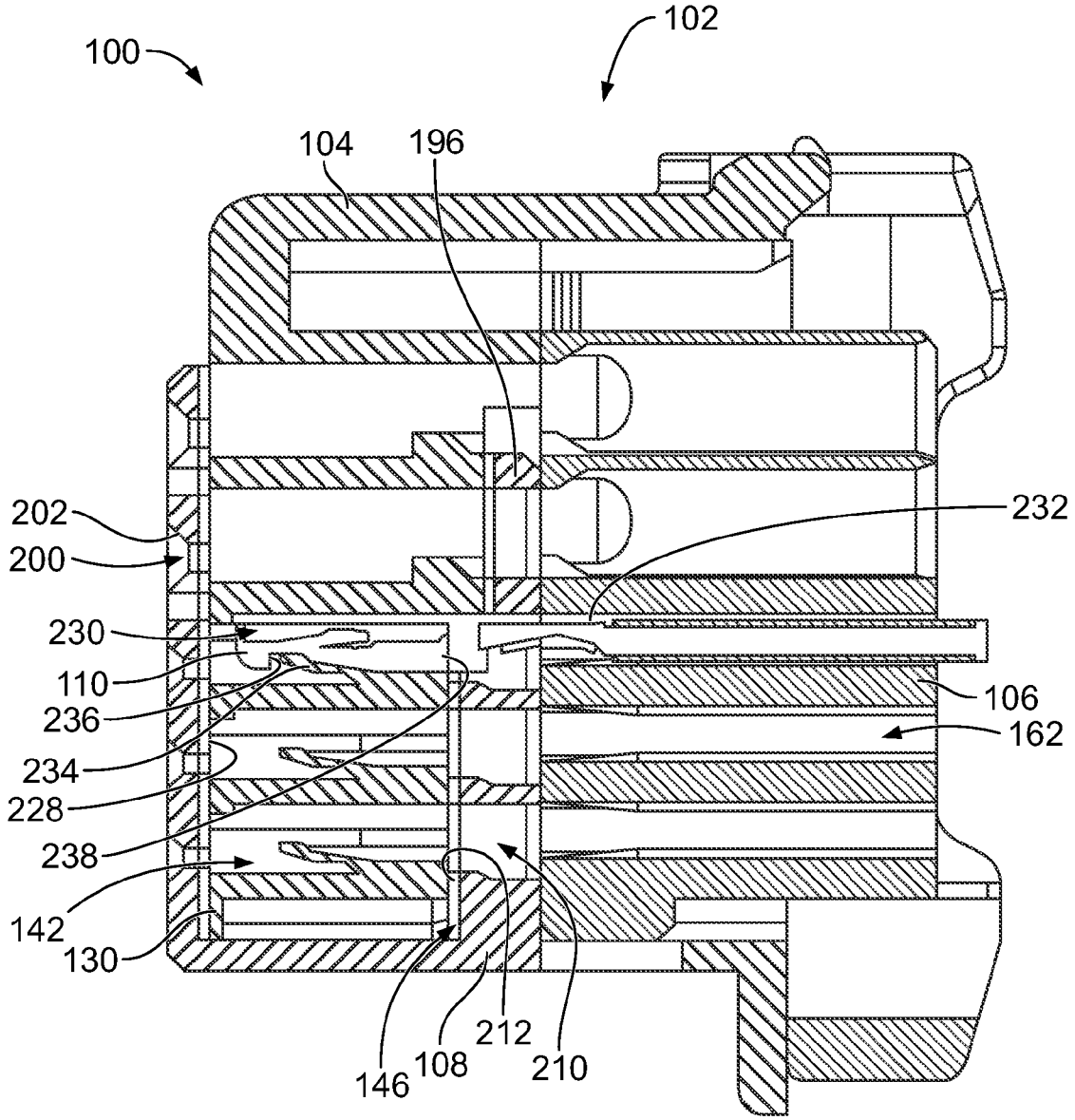
FIG. 5 is a cross-sectional view of the electrical connector showing an ISL device in an unlocked position.
Figure 6:
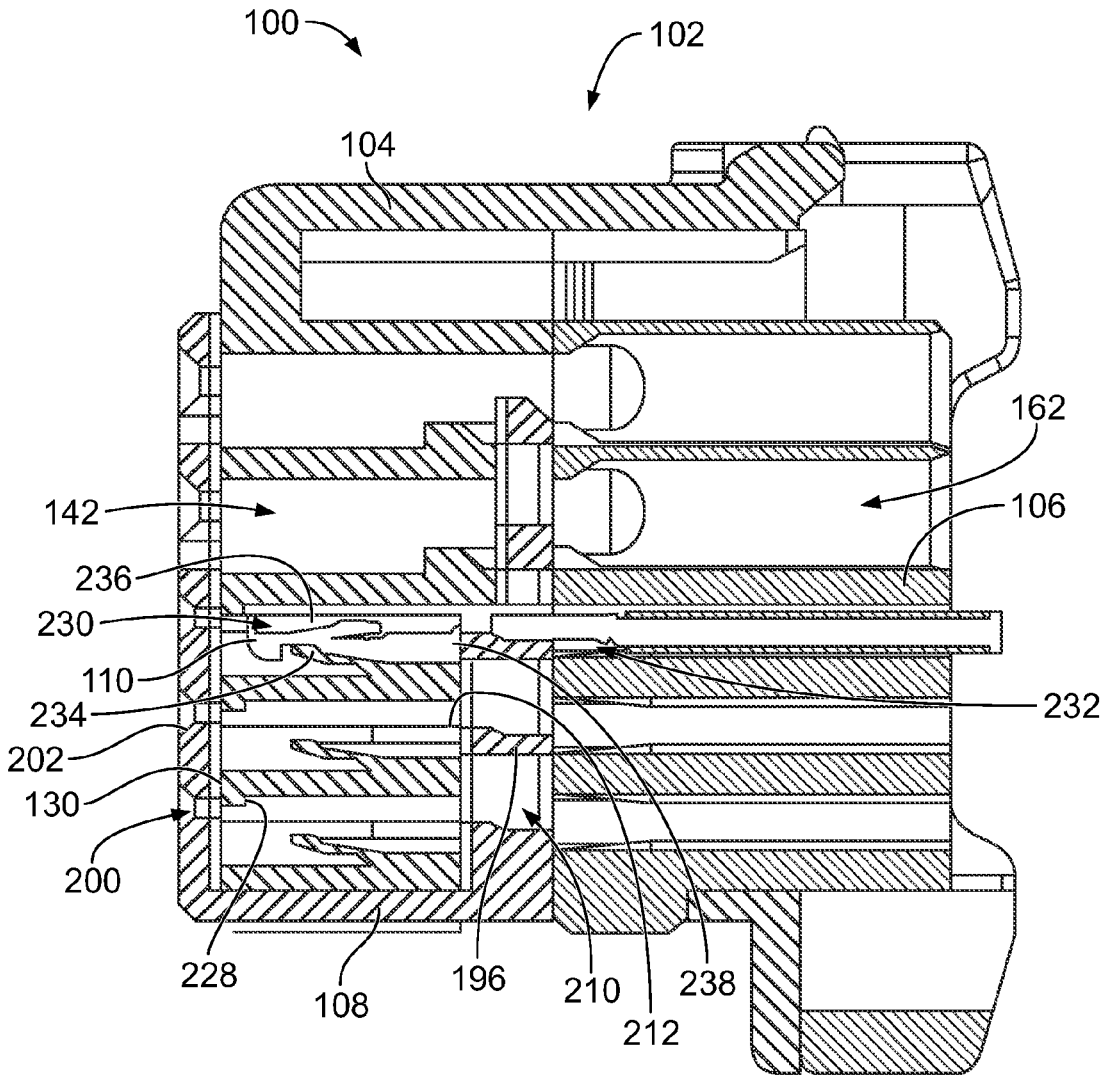
FIG. 6 is a cross-sectional view of the electrical connector showing the ISL device in a locked position.

FIG. 5 is a cross-sectional view of the electrical connector 100 showing the ISL device 108 in an unlocked position. FIG. 6 is a cross-sectional view of the electrical connector 100 showing the ISL device 108 in a locked position. One of the terminals 110 is shown loaded into the front terminal channels 142; however other terminals 110 may be loaded into the corresponding terminal channels 142 in a similar manner. The front housing 104 includes shoulders 228 proximate to the front 130 of the front housing 104. The shoulders 228 block forward movement of the terminals 110 in the front terminal channels 142. The terminals 110 may be loaded into the front terminal channels 142 until the terminals 110 abut against the shoulders 228. In an exemplary embodiment, the housing 102 includes different sized terminal channels 142, 162 for receiving different sized terminals 110, which may be used for different purposes, such as for transmitting signal and power.

During assembly, the rear housing 106 is coupled to the front housing 104 such that the terminal channels 142, 162 are aligned. In the unlocked position, the lock plate channels 210 are aligned with the terminal channels 142, 162 such that the terminals 110 may be freely loaded into the front terminal channels 142 through the rear terminal channels 162 and the lock plate channels 210. The terminals 110 are unobstructed when the ISL device 108 is in the unlocked position. The terminals 110 are simply loaded in a loading direction through the rear terminal channels 162 and the lock plate channels 210 into the front terminal channels 142 to fully loaded positions. In the unlocked position, the terminals 110 are also allowed to be removed from the front terminal channels 142 through the lock plate channels 210 and the rear terminal channels 162.

The terminals 110 have sockets 230 at front ends thereof, which are configured to be positioned in the front terminal channels 142 for mating with corresponding mating contacts, for example pins, of the mating connector (not shown). Optionally, portions of the terminals 110 may remain in the rear terminal channels 162 in the fully loaded positions. For example, cable ends 232, which may have crimp barrels, may be provided at the rear ends of the terminals 110. The cable ends 232 may at least partially extend into the rear terminal channels 162. In the illustrated embodiment, terminal latches 234 extend into the front terminal channels 142 to secure the terminals 110 in the fully loaded positions. The terminal latches 234 are deflectable. The terminal latches 234 engage latch surfaces 236 formed in the terminals 110 to hold the axial positions of the terminals 110 in the front terminal channels 142. The terminal latches 234 stop rearward movement of the terminals 110 from the front terminal channels 142.

After all of the terminals 110 are fully loaded into the housing 102, the ISL device 108 may be transferred to the locked position (FIG. 6). For example, the ISL device 108 may be pressed upward, pushing the lock plate 196 upward in the pocket 146. The ISL device 108 operates as a secondary lock for the terminals 110 that is used as a backup locking feature for securing the terminals 110 within the front terminal channels 142. When the ISL device 108 is moved to the locked position, the blocking surfaces 212 of the lock plate 196 may block portions of the terminals 110 and stop the terminals 110 from retracting out of the front terminal channels 142. For example, the terminals 110 may have rear edges 238, such as at the rear of the sockets 230, that are blocked (e.g. abut against) by the blocking surfaces 212 of the lock plate 196. The lock plate channels 210 are moved upward such that the lock plate channels 210 are at least partially offset relative to the front terminal channels 142. In the locked position, the front plate channels 200 are aligned with the front terminal channels 142 and the lead-in surfaces 202 guide the mating terminals into the front terminal channels 142. Having the lead-in surfaces 202 on the ISL device 108 simplifies the molding design of the front housing 104, making the front housing 104 less expensive to manufacture.

Optionally, the ISL device 108 may be used as a terminal position assurance device, assuring that the terminals 110 are fully loaded into the front terminal channels 142 during assembly. For example, when one of the terminals 110 is not fully loaded, the lock plate 196 may not be able to move from the unlocked position to the locked position, giving an indication to the assembler that such terminal(s) 110 is not fully loaded into the corresponding front terminal channel 142.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing including a front housing and a rear housing separately provided from and mateable to the front housing to define the housing;

the front housing having front terminal channels configured to receive terminals, the front housing having front keying features for aligning the front housing with the rear housing for mating thereto;

the rear housing having rear terminal channels aligned with the front terminal channels when the rear housing is mated with the front housing, the rear housing having rear keying features that interact with the front keying features to align the front housing with the rear housing during mating; and an independent secondary lock (ISL) device coupled to the housing, the ISL device having a front plate positioned in front of the front housing with front plate channels therethrough configured to be aligned with the front terminal channels, the ISL device having a lock plate positioned between the front housing and the rear housing with lock plate channels therethrough, the front plate being formed integral with the lock plate and being movable with the lock plate, the ISL device having a staged mating sequence with the housing, wherein in a first stage, the lock plate channels are aligned with the front and rear terminal channels to allow the terminals to at least partially pass therethrough from the rear terminal channels into the front terminal channels during loading of the terminals into the housing, and wherein in a second stage, the lock plate is moved relative to the housing to a blocking position where the lock plate blocks the terminals from removal from the front terminal channels, the front plate being moved relative to the housing with the lock plate from the first stage to the second stage, the front plate channels being aligned with the front terminal channels in the second stage.

2. The electrical connector of claim 1, wherein the front housing is manufactured from a first dielectric material and the rear housing is manufactured from a second dielectric material different from the first dielectric material.

3. The electrical connector of claim 1, wherein the front housing includes terminal latches in the front terminal channels, the terminal latches securing the terminals in the front terminal channels.

4. The electrical connector of claim 1, wherein the front terminal channels have shoulders proximate to a front of the front housing, the shoulders blocking forward movement of the terminals in the front terminal channels.

5. The electrical connector of claim 1, wherein the ISL device includes lead-in surfaces to the front plate channels, the lead-in surfaces configured to guide mating terminals into the front plate channels and the front terminal channels during mating with a mating connector.

6. The electrical connector of claim 1, wherein the ISL device includes blocking surfaces extending along the lock plate channels, the blocking surfaces are not aligned with the front terminal channels in the first stage, the blocking surfaces are aligned with the front terminals channels in the second stage such that the blocking surfaces block the terminals from removal from the front terminal channels.

7. The electrical connector of claim 1, wherein the front housing includes a bottom, the ISL device is positioned along the bottom, in the first stage, the ISL device is spaced from the bottom, the ISL device is moved upward to the second stage, in the second stage, the ISL device abuts against the bottom.

8. The electrical connector of claim 1, wherein the front housing includes a front and a rear, the rear housing includes a front and rear, the lock plate being positioned between the rear of the front housing and the front of the rear housing.

9. The electrical connector of claim 8, wherein at least one of the front housing and the rear housing includes a pocket receiving the lock plate, the lock plate being moveable in the pocket from the first stage to the second stage.

10. The electrical connector of claim 1, wherein the rear housing includes first and second latches, the ISL device including a latching mechanism, the latching mechanism being latchably secured to the first latch in the first stage, the latching mechanism being latchably secured to the second latch in the second stage.

11. The electrical connector of claim 1, wherein the front keying features comprise keying posts extending rearward from the front housing, the rear keying features comprise keying slots configured to receive corresponding keying posts.

12. The electrical connector of claim 1, wherein the rear keying features are arranged to receive different arrangements of front keying features from different front housings to allow different types of front housings to be coupled to the rear housing.

13. The electrical connector of claim 1, wherein the front keying features and rear keying features are configured to interact with keying features of a mating connector.

14. An electrical connector comprising:

a housing including a front housing and a rear housing separately provided from and mateable to the front housing to define the housing;

the front housing having front terminal channels configured to receive terminals, the front housing having terminal latches configured to latchably secure the terminals in corresponding front terminal channels, the front housing being manufactured from a first dielectric material;

the rear housing having rear terminal channels aligned with the front terminal channels when the rear housing is mated with the front housing, the rear housing being manufactured from a second dielectric material different than the first dielectric material; and an independent secondary lock (ISL) device coupled to the housing, the ISL device having a front plate positioned in front of the front housing with front plate channels therethrough configured to be aligned with the front terminal channels, the ISL device having a lock plate positioned between the front housing and the rear housing with lock plate channels therethrough, the front plate being formed integral with the lock plate and being movable with the lock plate, wherein the lock plate is configured to be positioned in a blocking position where the lock plate blocks the terminals from removal from the front terminal channels, the front plate channels being aligned with the front terminal channels when the lock plate is in the blocking position.

15. The electrical connector of claim 14, wherein the front housing includes terminal latches in the front terminal channels, the terminal latches securing the terminals in the front terminal channels.

16. The electrical connector of claim 14, wherein the ISL device includes lead-in surfaces to the front plate channels, the lead-in surfaces configured to guide mating terminals into the front plate channels and the front terminal channels during mating with a mating connector.

17. The electrical connector of claim 14, wherein the ISL device includes blocking surfaces extending along the lock plate channels, the blocking surfaces are aligned with the front terminals channels in the blocking position such that the blocking surfaces block the terminals from removal from the front terminal channels.

18. The electrical connector of claim 14, wherein the front housing includes a front and a rear, the rear housing includes a front and rear, the lock plate being positioned between the rear of the front housing and the front of the rear housing.

19. The electrical connector of claim 14, wherein the rear housing includes first and second latches, the ISL device including a latching mechanism, the latching mechanism being latchably secured to the first latch in a first stage, the latching mechanism being latchably secured to the second latch in a second stage, the ISL device in the blocking position in the second stage.

20. The electrical connector of claim 14, wherein the front housing has front keying features and the rear housing has rear keying features that interact with the front keying features to align the front housing with the rear housing during mating, wherein the rear keying features are arranged to receive different arrangements of front keying features from different front housings to allow different types of front housings to be coupled to the rear housing.

* * * * *